United States Patent [19]

Chazé

[11] 4,057,231

[45] Nov. 8, 1977

[54] CUPOLA FURNACE

[75] Inventor: Louis G. Chazé, Rennes, France

[73] Assignee: Centre Technique des Industries de la Fonderie, Paris, France

[21] Appl. No.: 584,387

[22] Filed: June 6, 1975

[30] Foreign Application Priority Data

June 27, 1974 France ..... 74.22491

[51] Int. Cl.[2] ..... F27B 1/20

[52] U.S. Cl. ..... 266/219; 266/239; 266/900; 266/230

[58] Field of Search ..... 75/43, 44 R, 44 S, 24, 75/44; 266/42, 195, 196, 236, 239, 227, 229, 230, 231, 900, 219

[56] References Cited

U.S. PATENT DOCUMENTS 3,589,699 6/1971 Bogan ..... 266/42

FOREIGN PATENT DOCUMENTS 1,013,838 5/1952 France ..... 75/43

*Primary Examiner*—M. J. Andrews

*Attorney, Agent, or Firm*—Brooks, Haidt, Haffner & Delahunty

[57] ABSTRACT

The invention relates to a process for automatically deslagging a cupola furnace and to an improved cupola furnace using this process.

According to the invention the bottom of the crucible is permanently connected to atmosphere via a siphon sill whose level is determined so that the interface between pig iron and slag is sometimes above and sometimes below this sill. The side wall of the cupola furnace has on the one hand a taphole for the pig iron opening into the crucible level with the hearth and which can be sealed with a plug and on the other air blowing tuyeres in the upper part of the crucible, as well as a siphon linked with the crucible for the supply thereof by means of a passage whose lower edge is adjacent to the bottom of the crucible and whose upper sill extends below the maximum permitted pig iron level determined by the siphon outflow, whereby the maximum permitted slag level is located below the nozzles.

6 Claims, 6 Drawing Figures

CUPOLA FURNACE

Figure 1:
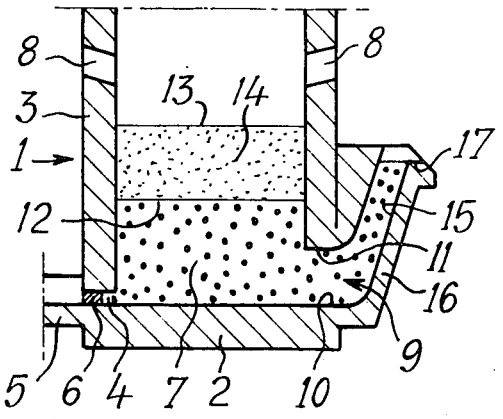

The present invention relates to an automatic deslagging process for a cupola furnace with intermittent removal of the pig iron by tapping and to the improved cupola furnace using this process.

Known cupola furnaces with intermittent removal of the pig iron by tapping have the advantage of maintaining the pig iron hot in the crucible between two successive uses. Accordingly these cupola furnaces have a taphole for the pig iron provided in the side wall thereof and opening into the crucible level with the hearth. This taphole is normally sealed with a refractory plug and when it is desired to remove pig iron the cupolaman disintegrates the plug until the pig iron appears and flows along the tapping chute.

These known cupola furnaces also have at least one slag notch, which is also normally sealed by a refractory plug between the pig iron tapping chute and the air blowing tuyeres in the upper part of the crucible. As the slag accumulates above the pig iron during the melting thereof the slag has to be removed by interrmittent tapping operations.

Tapping is carried out manually and if well performed the slag flows away violently but consequently granulation thereof under a water jet is impossible. Granulation facilitates handling of the product and improves working conditions round the crucible. In actual fact tapping is very often performed in an unsatisfactory manner, lasting a long time with gasses being discharged to the outside through the slag notch in the upper part of the crucible, which impairs the operation of the cupola furnace.

Moreover the often violent spattering of slag in unexpected directions makes the operation dangerous and leads to arduous working conditions.

Furthermore, if the cupolaman is not careful and the slag level is difficult to control there is a danger of the air blowing tuyeres being invaded and at least partially blocked by the slag.

In addition, the blocking of the slag notch causes the stopping of the blast, in theory for a few minutes but often for more than ten minutes. It is not therefore surprising that this also impairs the operation of the cupola furnace.

Moreover the thickness of the slag layer in the crucible varies between 0 and 300mm which obviously leads to variations in the pig iron quality.

Furthermore pig iron and slag removal are both manual operations, so that the human factor is determinative for achieving optimum operating conditions and it is obvious that a greater or lesser disturbance of cupola furnace operation occurs.

The problem of the present invention is to obviate these disadvantages by providing an automatic deslagging process and using this process in a cupola furnace in such a way that the slag flows off freely without manual intervention and spread over 50 to 60% of the operating period, optionally permitting granulation with no danger of the slag solidifying.

According to the invention this problem is solved by a process wherein during the intermittent tapping of the pig iron the bottom of the crucible is permanently connected to atmosphere via a siphon sill whose level is determined in such a way that the interface between the pig iron and the slag is sometimes located above and sometimes below the crucible sill.

The side wall of the cupola furnace has on the one hand a taphole for the pig iron opening into the crucible level with the hearth and which can be sealed with a plug and on the other air blowing tuyeres in the upper portion of the crucible. It always has in combination a siphon which communicates with the crucible for the supply thereof by a passage whose lower edge is adjacent to the bottom of the crucible and whose upper edge extends below the maximum permitted level for the pig iron which is determined by the level of the siphon overflow, whereby the maximum permitted slag level is located below the tuyeres.

Other characteristics and advantages of the invention can be gathered from the following description of one non-limitative embodiment of the invention with reference to the attached drawings.

FIGS. 1 to 6 are schematic sections showing the improved part of the cupola furnace according to the invention, illustrating various characteristic phases of its operation.

At the base of the cupola furnace is located a crucible 1 comprising a hearth 2 and a side wall 3 of a refractory material lining a metal jacket.

Wall 3 defines a taphole 4 for the pig iron opening internally level with the hearth 2 and externally into a chute 5. Hole 4 is sealed by a plug 6 when pig iron 7 is not being used and when it therefore accumulates in the crucible as the charge melts.

Wall 3 also defines in the upper part of the said crucible openings 8 distributed in equiangular manner over the periphery and converging slightly downwards. These openings serve to receive air blowing tuyeres connected to a wind box surrounding the structure.

Opposite to taphole 4 wall 3 finally defines a passage 9 whose lower edge 10 is adjacent to hearth 2 and whose upper sill 11 is positioned relative to the maximum levels 12 and 13 of pig iron 7 and slag 14 respectively in such a way that the slag flows away through the said passage if the pig iron level drops during tapping operation, but cannot do so between two successive tapping operations, so that it accumulates above this level to take part in making the pig iron.

Passage 9 provides a permanent connection between the bottom of the crucible 1 and the internal upwardly directed pipe 15 of a siphon 16 whose overflow 17 is located above sill 11 and at a level which determines the maximum level 13 of slag 14 below the tuyeres of openings 8, as well as the maximum thickness of this slag.

The automatic deslagging device operates in the manner described with reference to FIGS. 1 to 6.

Prior to a tapping operation, FIG. 1, pig iron 7 is at its maximum level 12 in crucible 1 and under the action of the internal pressure has a higher level in siphon 16 because it is level with overflow 17.

Figure 2:
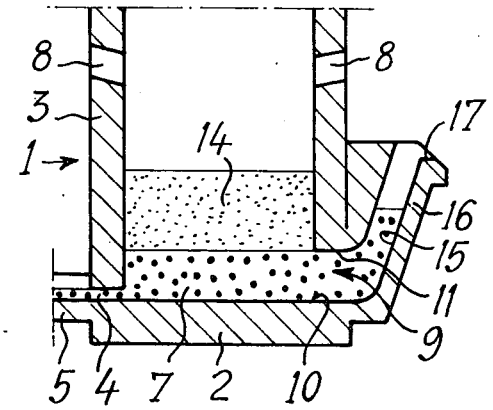

On performing a taping operation the pig iron 7 flows through hole 4 whose plug 6 has disappeared, FIG. 2. The level thereof drops both in crucible 1 and in siphon 16. As soon as slag 14 reaches the level of sill 11 and transfer takes place between crucible 1 and pipe 15 of siphon 16, FIGS. 2 and 3.

Figure 3:
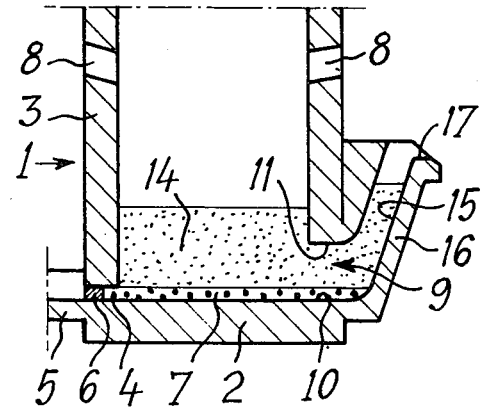
Figure 4:
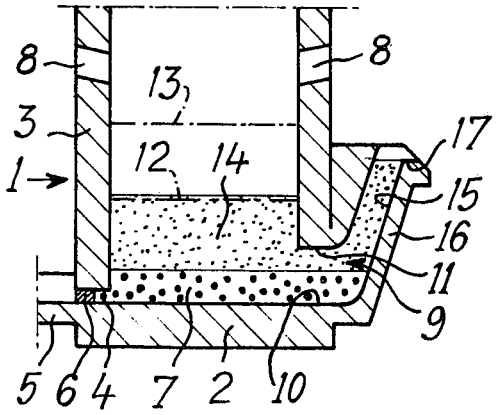
Figure 5:
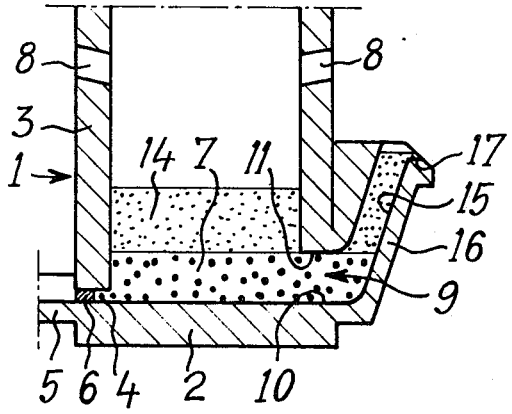

When tapping of the pig iron is completed a new plug 6 is fitted in hole 4, FIG. 3, whereby a relatively thin layer of pig iron is left in the bottom of the crucible.

As blasting continues the pig iron accumulates again. Its level rises as does therefore the slag layer which thickens and when this slag reaches the level of overflow 17 it freely flows out in continuous manner which permits granulation.

The rise in the pig iron level continues and when it reaches sill 11 the link between crucible 1 and siphon 16 is interrupted. A slag layer of adequate thickness for correctly making the pig iron is therefore retained in the crucible, FIG. 5.

Figure 6:
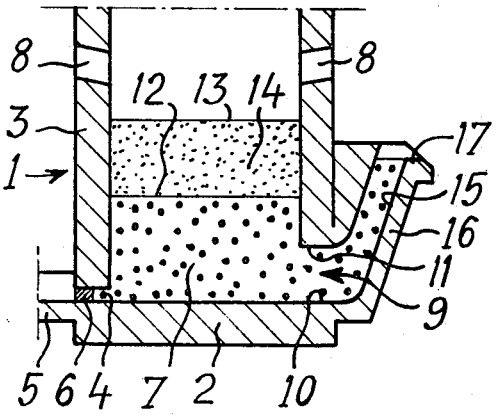

The pig iron level continues to rise both in crucible 1 upwardly displacing the slag layer whose thickness increases and in siphon 16 forcing the slag left in the siphon over overflow 17, FIG. 6.

When the pig iron is level with overflow 17, FIG. 6, its maximum level in crucible 1 is reached, as is the level 13 of the slag. Blasting can be stopped, if necessary for preventing the pig iron overflowing. However, blasting is generally not interrupted, so that a further tapping operation is possible. It must be sufficient for the excess slag to pass over sill 11 and be dischared via siphon 16. The dimensions of the device must be such that the slag opposes any passage of air beneath sill 11 towards siphon 16.

The automatic deslagging device described hereinbefore has numerous advantages:

Slag outflow takes place automatically without any intervention by the cupolaman.

As this outflow is continuous and spread over the period between two successive interruptions caused by the rise of the pig iron, slag granulation is possible.

The replacement of the slag taphole by a siphon makes it possible to eliminate the passage of blast through this hole, thus avoiding a disturbance of cupola furnace operation. It also eliminates the hole plugging operation. Finally it results in the elimination of violent spattering and consequently improves working conditions and safety.

There is no longer any danger of the air blowing tuyeres being invaded by slag because it is possible to see when the latter has reached the maximum permitted level. In fact it is sufficient to stop the blast as soon as the pig iron appears at the overflow when a tapping operation cannot take place immediately.

The slag layer thickness is made more regular due to the periodic tapping operations via the siphon by the fluctuations in level of the pig iron. The operation of the cupola furnace is then better stabilised and the pig iron quality corresponds more closely to what could be expected from the operation of the cupola furnace.

The operation of the cupola furnace can be made semi-automatic because with the siphon operating it is sufficient to adopt a mechanical sealing system for the pig iron taphole (of the Gruillamon plug type) and self-cleaning tuyeres with automatic inversion.

Obviously certain precautions must be taken for the device according to the invention satisfactorily:

The slag siphon must be thermally insulated and preheated.

The levels of sill 11 and outflow 17 must be appropriately positioned for each cupola furnace.

The pig iron tapping operations must be regularly programmed as regards time and quantity.

This device is applicable to the automatic deslagging of cupola furnaces with intermittent removal of the pig iron by tapping.

What is claimed is:

1. A cupola furnace for containing molten iron and slag with the slag on top of the molten iron and from which both the molten iron and slag are removed discontinuously, said furnace comprising a crucible with a lower wall and a wall extending upwardly from said lower wall for containing said molten iron with said slag on the top of said molten iron, one said wall having a first opening at said lower wall of said crucible for removing molten iron from said crucible at said lower wall and said upwardly extending wall having a second opening therein at said lower wall of said crucible and spaced from said first opening, and a siphon tube with an inlet and an outlet having its inlet connected to said second opening and having its outlet above the uppermost portion of said second opening, said first opening being disposed to permit removal of said molten iron until the upper level thereof is spaced from said lower wall by a distance no greater than the distance between said lower wall and the uppermost portion of said first opening, and said second opening being disposed and having a size such that said uppermost portion thereof is above said uppermost portion of said first opening and the lowermost portion of said second opening is at least as close to said lower wall as said uppermost portion of said first opening, whereby said crucible may contain molten iron and slag having upper levels above said uppermost portion of said second opening, the molten iron may be withdrawn through said first opening until the upper level thereof is at most as low as said uppermost portion of said first opening and until said slag passes through said second opening into said tube and thereafter, the level of said molten iron may be raised to cause said slag to flow out of said outlet.

2. A furnace as set forth in claim 1, wherein said lowermost portion of said second opening is as close to said lower wall as the lowermost portion of said first opening.

3. A furnace as set forth in claim 2, wherein said first opening and said second opening extend horizontally through said upwardly extending wall and the lowermost portions of said first opening and said second opening are substantially co-extensive with the upper surface of said lower wall.

4. A furnace as set forth in claim 3, wherein said lowermost portion of said second opening forms an extension of said lower wall and wherein said uppermost portion of said second opening overlies said extension and forms a sill.

5. A furnace as set forth in claim 1, further comprising tuyeres in said upwardly extending wall for blowing air into said crucible, said tuyeres being above said outlet and above the level of said slag when said molten iron is at the level of said outlet.

6. A furnace as set forth in claim 1, further comprising means for alternately closing and opening said first opening thereby respectively preventing and permitting flow of said molten iron through said first opening.

* * * * *